US006862911B2

(12) United States Patent
Birkenstock et al.

(10) Patent No.: US 6,862,911 B2
(45) Date of Patent: Mar. 8, 2005

(54) METHOD FOR CUTTING EXTRUDED PROFILE SECTIONS INTO LENGTHS

(75) Inventors: Alf Birkenstock, Heiligenhaus (DE); Markus Jandewerth, Bottrop (DE); Paul Hinzmann, Wuppertal (DE)

(73) Assignee: WKW Erbsloh Automotive GmbH, Velbert (DE)

( * ) Notice: Subject to any disclaimer, the term of this patent is extended or adjusted under 35 U.S.C. 154(b) by 0 days.

(21) Appl. No.: 10/736,240

(22) Filed: Dec. 15, 2003

(65) Prior Publication Data

US 2004/0163438 A1 Aug. 26, 2004

Related U.S. Application Data

(63) Continuation of application No. PCT/EP03/02231, filed on Mar. 5, 2003.

(30) Foreign Application Priority Data

Mar. 5, 2002 (DE) ..... 102 09 481

(51) Int. Cl.[7] ..... B21C 23/00
(52) U.S. Cl. ..... 72/254; 72/256; 72/257
(58) Field of Search ..... 72/166, 169, 185, 72/254, 256, 257, 260, 364

(56) References Cited

U.S. PATENT DOCUMENTS 4,653,364 A * 3/1987 Savioli ..... 83/37
5,305,626 A 4/1994 Tiekink
5,490,408 A * 2/1996 Ando et al. ..... 72/256
5,743,124 A * 4/1998 Sugiyama et al. ..... 72/166
5,907,968 A * 6/1999 Muschalik et al. ..... 72/257
2003/0178529 A1 * 9/2003 Chevalier ..... 244/53 R

FOREIGN PATENT DOCUMENTS

DE 24 21 425 C2 3/1982
DE 36 30 601 C2 3/1999
DE 196 37 175 C2 12/2001
EP 0 706 843 A1 4/1996
EP 1 038 623 A2 9/2000
JP 6-15372 * 1/1994 ..... B21C/23/00

* cited by examiner

*Primary Examiner*—Ed Tolan
(74) *Attorney, Agent, or Firm*—Katten Muchin Zavis Rosenman

(57) ABSTRACT

A method for cutting a hollow extruded profile section into lengths in a press flow, wherein the extruded profile section is bent upon exit from the press either simultaneously with or directly after the forming extrusion process by a force acting thereon in a transversal manner in relation to the direction of the extruding press, and a force component acts as a traction of pressure force during the forming extrusion process on the cross-sectional area of the hollow-profile walls thus arising. The bent extruded profile section is cut in the press flow by the mechanical action of a saw, whereby force exerted on the extruded profile section during cutting is compensated by a supporting device arranged adjacent to the extruded profile section, so that deformation of the bent extruded profile section is prevented.

19 Claims, 1 Drawing Sheet

METHOD FOR CUTTING EXTRUDED PROFILE SECTIONS INTO LENGTHS

CROSS-REFERENCE TO RELATED APPLICATIONS

This is a continuation of International Application PCT/EP03/02231, filed Mar. 5, 2003.

FIELD OF THE INVENTION

The present invention relates to a method for cutting an extruded profile section into lengths in the press flow of an extrusion machine. More precisely, it relates to a method for cutting an extruded profile section into lengths wherein the said profile section, after discharge from the press, is bent simultaneously with or immediately after the forming extrusion process by a force acting on the extruded profile section at right angles to the extrusion direction, one component of the force acting as a tensile or compressive force on the cross-sectional face of the resulting profile-section walls during the forming extrusion process.

BACKGROUND OF THE INVENTION

In industry, profiled workpieces are often produced on the basis of profile sections formed by extrusion of semifinished products. Depending on the material used in the semifinished product, extrusion takes place at a temperature that ensures plastic deformability. For example, aluminum or magnesium alloys are generally extruded at temperatures of 250° C. to 600° C. For further processing of the extruded profile sections, they must be cut into lengths corresponding to the respective dimensions of the profiled workpieces to be manufactured. Predominantly mechanical parting machines, such as saws or shears, are used for cutting into lengths.

Heretofore, if bent extruded profile sections are to be cut into lengths by mechanical parting means, they have had to be in cooled condition. Otherwise, because of the mechanical stress and strain during the parting process, it is not possible to rule out deformation of the profile sections and thus corresponding contour inaccuracies. Unfortunately, this prolongs the total production time, reduces the output of finished workpieces, leads to higher operating costs and ultimately makes the manufacturing process less economical.

Heretofore, it is only for straight profile sections that it has been possible, by means of "flying shears" for example, to cut extruded profile sections into lengths in the press flow while the said sections are still hot. In order to avoid a high proportion of scrap, straight profile sections are subjected to at least one further process step, in which the end contour of the profile sections are sized. Conventional straightening jigs are generally used for this purpose. If contour inaccuracies are caused by the parting means during the parting process, they are corrected by straightening. Straight profile sections are typically cut into profile-section lengths ranging from 30 to 50 meters, in order to keep the material losses small in relative terms. These losses, which are inevitable during straightening because of the need to clamp the profile-section lengths, amount to about 1 to 2 meters.

If the profile sections are subjected to plastic deformation by the action of external forces as they are discharged from the extrusion machine, or in other words if they are bent into a specified three-dimensional shape, straightening of the cut lengths of profile section is no longer feasible. If contour inaccuracies are caused while the profile sections are being cut into lengths, sizing must be performed in a technically complex contour-forming jig matched to the cut lengths of profile section. Furthermore, depending on the bend radius, in the case, for example, of profile sections bent in circular form, the lengths of the profile section must often be cut off at much shorter intervals, such as intervals of about 1 meter, in order to avoid "overrunning" of the profile section. Such relatively short lengths of profile section, however, can in general be sized only with relatively high material loss. In the case of profile sections bent after discharge from the press, therefore, it is necessary in each case to prevent contour inaccuracies caused by cutting the profile section into lengths in the press flow while the said sections are still hot.

In contrast, the object of the present invention is to provide a method of the type mentioned in the introduction, wherein the extruded profile section can be cut into lengths in the press flow while the said section is still hot, without fear that the profile section may be deformed.

SUMMARY OF THE INVENTION

The present invention describes a method for cutting a hollow extruded profile section into lengths in the press flow, which method is characterized in that the bent extruded profile section is cut into lengths in the press flow by the mechanical action of a saw, the force exerted on the extruded profile section while it is being cut into lengths being compensated by a support means that bears on the extruded profile section in such a way that deformation of the bent extruded profile section is prevented, the extruded profile section being made of an aluminum alloy or a magnesium alloy and having a temperature in the range of 200° C. to 600° C., preferably 500° C. to 600° C., while it is being cut into lengths.

The invention relates exclusively to an extruded profile section that, after discharge from the press, is bent simultaneously with or immediately after the forming extrusion process by a force acting on the extruded profile section at right angles to the extrusion direction, one component of the force acting as a tensile or compressive force on the cross-sectional face of the resulting profile-section walls during the forming extrusion process. Such a method of bending extruded profile sections is described in European Patent 0706843 B1. According to that publication, the action of the force on the extruded profile section can be produced, for example, by a roll, by a sliding surface that generates a force at right angles, by a roller cage or by similar means.

The saw is advantageously guided on a guide tool. For this purpose, the saw can be braced on the guide tool, or alternatively the guide tool can be braced on the saw.

The saw can be advantageously dimensioned such that the entire cross section of the extruded profile section is overlapped by its cutting depth. This ensures that the extruded profile section can be severed in a time saving manner with a single feed motion of the parting tool.

In the inventive method, it is possible to part the extruded profile section while it is stationary. Alternatively, if the extruded profile section is being moved in the press flow, the saw can be moved together with the extruded profile section during the parting process.

In a particularly advantageous embodiment of the invention, the saw is equipped with a means of compensating for play in the pressure direction. This ensures that the speed of the press flow can be advantageously maintained without any decrease, even if relatively long parting times are to be expected, especially in the case of relatively thick profile sections. This compensation capability prevents unwanted and possibly even damaging influences on the saw and/or extruded profile section. Such influences are possible due to the fact that the movement of the extruded profile section in the press flow causes a transverse load on the saw during the parting process.

The feed speed of the saw is advantageously adapted to the profile-section cross sections, which may or may not be different, and so severe wear due to excessive stress and strain on the material of the saw can be prevented. Hereby longer useful lives of the tools can be achieved, in turn further improving the economics of the method.

When a saw is used as a parting tool, the problem frequently occurs that the teeth of the saw blade become clogged with the hot chips of the extruded profile section. To prevent this, a conventional cutting fluid is advantageously applied continuously to the saw blade during the parting process, in order to prevent the hot chips from remaining adhered to the teeth and thus causing the teeth to become clogged by the chips. The cutting fluid is applied to the saw blade by atomization, for example. It can be used at the same time as cooling fluid for the saw blade.

In a preferred embodiment of the invention, the guide tool for guiding the parting tool is a robot. The robot is equipped for this purpose with a robot arm that can be controlled according to the movement and/or curvature of the extruded profile section. The saw can be positioned by the robot arm in a selectable position on the extruded profile section. Advantageously, such positioning is effected as close as possible to the extruded profile section, so that the parting process is completed as quickly as possible by virtue of the short path to be traveled, and so that relatively high extrusion speeds are possible. The positioning of the saw by means of the robot arm takes place advantageously under the control of a higher-level central controller, which is programmed with the appropriate necessary data describing the exact shape of the stretched or bent or curved extruded profile section. In this way, the saw can be brought to practically any desired selectable positions close to the extruded profile section, within the scope of the movement capabilities imparted to the robot arm, of course, in order to sever the extruded profile section at that position.

The fact that the robot arm is controlled by a higher-level central controller also ensures that the robot arm is guided in such a way during cutting into lengths that it practically does not move relative to the extruded profile section while this is moving in the press flow.

As is already achieved by the aforesaid means for compensating for play in the pressure direction, such guidance of the robot arm together with the extruded profile section prevents the different directions of movement of saw and extruded profile section during parting from having damaging influence on the profile section and/or tool.

According to the invention, the feed of the saw advantageously takes place relative to a guide device that moves together with the robot arm and in particular permits one-dimensional movement. By virtue of this movement capability, the saw can therefore be guided through the extruded profile section without corresponding movement of the robot arm. In particular, the computing work for control of the robot arm is then greatly simplified, if the robot arm is to be moved together with the extruded profile section during the parting process, and if combined movement of the robot arm is necessary for associated guidance of the robot arm and for movement of the saw during the parting process.

In the case of profile sections made of an aluminum alloy, the extrusion speed during cutting into lengths can range from 10 to 30 m/min. Preferably it ranges between 20 and 30 m/min and especially preferably is approximately 25 m/min. If a magnesium alloy is used, the extrusion speed usually ranges between 1 and 5 m/min, and especially preferably is approximately 2 to 3 m/min. For profile sections of aluminum or magnesium alloys, the parting time is preferably shorter than approximately 4 seconds, and particularly preferably is approximately 2 seconds.

BRIEF DESCRIPTION OF THE DRAWINGS

The present invention will now be explained in more detail with reference to FIG. 1, wherein.

DETAILED DESCRIPTION OF THE INVENTION

Figure 1:
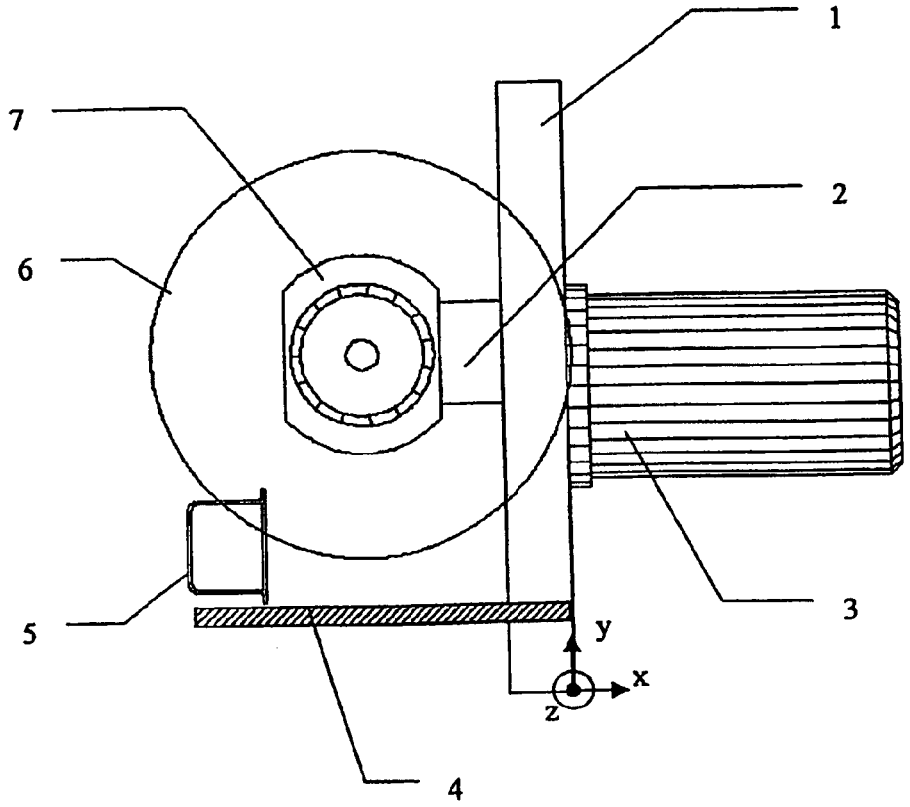
FIG. 1 shows a schematic view of a means for performing the inventive method.

FIG. 1 is intended to illustrate the inventive method. The diagram is drawn in a Cartesian coordinate system, whose XY plane is parallel to the plane of the paper, and whose Z-axis is perpendicular to the XY plane. There is shown a robot arm 3, which at its end guides a parting tool configured as a saw and positioned close to an extruded profile section 5. Extruded profile section 5 is illustrated in cross section. Thus, in the press flow, it is being moved in the Z direction. In the present case, the hollow extruded profile section is made of an aluminum alloy. Alternatively, it could just as well be made of a magnesium alloy.

Mechanical parting of extrusion profile 5 takes place by saw blade 6, which is disposed in the XY plane and is powered in rotary motion via main drive 7. For parting of extrusion profile section 5, saw blade 6 is guided in Y direction through extruded profile section 5, while the saw is being moved along a feed axis 1 in the direction of the Y-axis. During cutting into lengths, the hollow extruded profile section has a temperature in the range of 200° C. to 600° C., preferably 500° C. to 600° C.

In order to prevent deformation of the extruded profile section or inaccuracies in the contour as a result of the mechanical forces acting on extruded profile section 5 during the parting process, a steadying member 4 in the form of a flat plate disposed in the XZ plane bears on extruded profile section 5 in order to support it. Steadying member 4 absorbs the mechanical forces exerted by the saw on extruded profile section 5 in Y direction during the parting process, thus preventing deformation and alteration of the contour of extruded profile section 5. The saw is additionally equipped with a means in the form of a compensating bearing 2 for compensation of axial play, in order to compensate for the movement of extruded profile section 5 in Z direction during the parting process. In addition, robot arm 3 can be moved together with extruded profile section 5 in the Z direction, while maintaining its position relative to extruded profile section 5. Control of the robot arm is exercised by a central controller (not illustrated), which knows the exact shape of the extruded profile section. By virtue of the existing feed axis 1, the movement of robot arm 3 corresponding to the moving extruded profile section, and the movement of the saw through extruded profile section 5 during the parting process, are decoupled in the Y direction.

Associated guidance of robot arm 3 together with the moving extruded profile section in the press flow comes into consideration mainly for thick profile sections, which need a relatively long parting time, and/or for high extrusion speeds. Frequently, however, the ability to compensate for axial play achieved by compensating bearing 2 of saw blade 6 will already be sufficient to prevent the different directions of movement of parting tool and extruded profile section from causing damage to saw blade 6 and/or to extruded profile section 5 during the parting process.

By means of the inventive method it is possible in every case to ensure that desired part lengths of extruded profile sections can be parted rapidly and exactly in the press flow, without having to tolerate disadvantageous impairment of the contour. The total time for production of the profiled workpieces is clearly shorter than in conventional methods of cutting into lengths. Thus it permits higher production output per unit time and contributes favorably to the economics of the method.

We claim:

1. A method for cutting a hollow extruded profile section into lengths in a press flow, wherein the extruded profile section, after discharge from a press, is bent simultaneously with or immediately after the forming extrusion process by a force acting on the extruded profile section at right angles to the extrusion direction, one component of the force acting as a tensile or compressive force on the cross-sectional face of the hollow profile section walls during the forming extrusion process, the method comprising the steps of:

cutting the extruded profile section into lengths in the press flow by the mechanical action of a saw, and supporting the extruded profile section on a support means during cutting to prevent deformation of the extruded profile resulting from the force exerted on the extruded profile section while it is being cut into lengths, such deformation being prevented by the support means bearing on the extruded profile section during cutting, the extruded profile section being made of an aluminum alloy or a magnesium alloy and having a temperature in the range of 200° C. to 600° C. while it is being cut into lengths.

2. A method according to claim 1, wherein the extruded profile section has a temperature in the range of 500° C. to 600° C. while it is being cut into lengths.

3. A method according to claim 1, wherein the saw is guided on a guide tool.

4. A method according to claim 3, wherein the saw is braced on the guide tool.

5. A method according to claim 3, wherein the guide tool is braced on the saw.

6. A method according to claim 1, wherein the saw is dimensioned such that the entire cross section of the extruded profile section is overlapped by its cutting depth.

7. A method according to claim 1, wherein the saw is equipped with a means of compensating for play in a pressure direction.

8. A method according to claim 1, wherein the saw is moved together with the extruded profile section during the cutting step.

9. A method according to claim 1, wherein the guide tool is a robot, with a robot arm that is controlled according to the movement and/or curvature of the extruded profile section.

10. A method according to claim 9, wherein the saw is positioned by the robot arm in a selectable position close to the extruded profile section.

11. A method according to claim 9, wherein the feed of the saw takes place relative to a guide device that moves together with the robot arm.

12. A method according to claim 11, wherein the feed of the saw relative to the robot arm takes place in one dimension.

13. A method according to claim 1, wherein during the cutting step, the speed of extrusion of an extruded profile section made of an aluminum alloy ranges from 10 to 30 m/min.

14. A method according to claim 13, wherein the speed of extrusion is approximately 25 m/min.

15. A method according to claim 1, wherein during the cutting step, the speed of extrusion of an extruded profile section made of a magnesium alloy ranges from 1 to 5 m/min.

16. A method according to claim 15, wherein the speed of extrusion ranges from 2 to 3 m/min.

17. A method according to claim 1, wherein a parting time during the process of cutting of the extruded profile section is at most 4 seconds.

18. A method according to claim 17, wherein the parting time during the process of cutting is approximately 2 seconds.

19. A method according to claim 1, wherein when extruded profile sections of different cross sections are being cut into lengths, the rate of metal removal during the cutting processes is substantially the same.

* * * * *